US006247948B1

(12) United States Patent
Davis et al.

(10) Patent No.: US 6,247,948 B1
(45) Date of Patent: Jun. 19, 2001

(54) ELECTRICAL CONNECTOR AND PANEL ASSEMBLY

(75) Inventors: Wayne Samuel Davis, Harrisburg; Robert Neil Whiteman, Jr., Middletown, both of PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/245,750

(22) Filed: Feb. 8, 1999

(51) Int. Cl.[7] ..... H01R 29/00

(52) U.S. Cl. ..... 439/188; 439/353; 439/660; 200/51.09

(58) Field of Search ..... 439/660, 637, 439/862, 65, 357, 668, 344, 188; 200/50.19

(56) References Cited

U.S. PATENT DOCUMENTS

| | | | | |
|---|---|---|---|---|
| 4,691,486 | | 9/1987 | Niekrasz et al. | 52/172 |
| 5,170,067 | * | 12/1992 | Baum et al. | 439/668 |
| 5,259,777 | * | 11/1993 | Schuder et al. | 439/188 |
| 5,295,843 | * | 3/1994 | Davis et al. | 439/660 |
| 5,928,019 | | 7/1999 | Chen et al. | 439/188 |

FOREIGN PATENT DOCUMENTS

| | | |
|---|---|---|
| 0 817 217 A2 | 1/1998 | (EP) . |
| WO 98/42163 | 9/1998 | (WO) . |

OTHER PUBLICATIONS

Abstract from Case No. 17277, Ser. No. 09/245,750, Filed Feb. 8, 1999, Related Application.
Drawings from Case No. 17277, Ser. No. 09/245,750, Filed Feb. 8, 1999, Related Application, 9 sheets.

* cited by examiner

*Primary Examiner*—Renee Luebke
*Assistant Examiner*—Briggitte R. Hammond

(57) ABSTRACT

An electrical interlock connector (40) includes an insulating housing (42) containing at least one terminal-receiving cavity (46) with an electrical terminal (58) disposed therein and a first circuit member (70) connected to a power source and attached to the housing (42). The terminal (58) includes a spring section (62) having an outer connecting portion (61) adapted to be electrically connected to an electrical unit (28). The outer connecting portion (61) resiliently extends outwardly of a first housing surface (41) to an open position wherein the terminal (58) and the first circuit member (70) are electrically disconnected. The outer connecting portion (61) is movable into the cavity (46) to a closed position by a first portion (26) of the apparatus (20) upon mounting the connector against first and second portions (26, 36) of the apparatus. The connector (40) has a section (69) along a second housing surface (43) that engages the second apparatus portion (36), whereby an inner connecting portion (63) of the spring section (62) is at least in electrical connection with the first circuit member (70) only when the connector (40) is against the first and second apparatus portions (26, 36) and the terminal (46) is in its closed position.

40 Claims, 14 Drawing Sheets

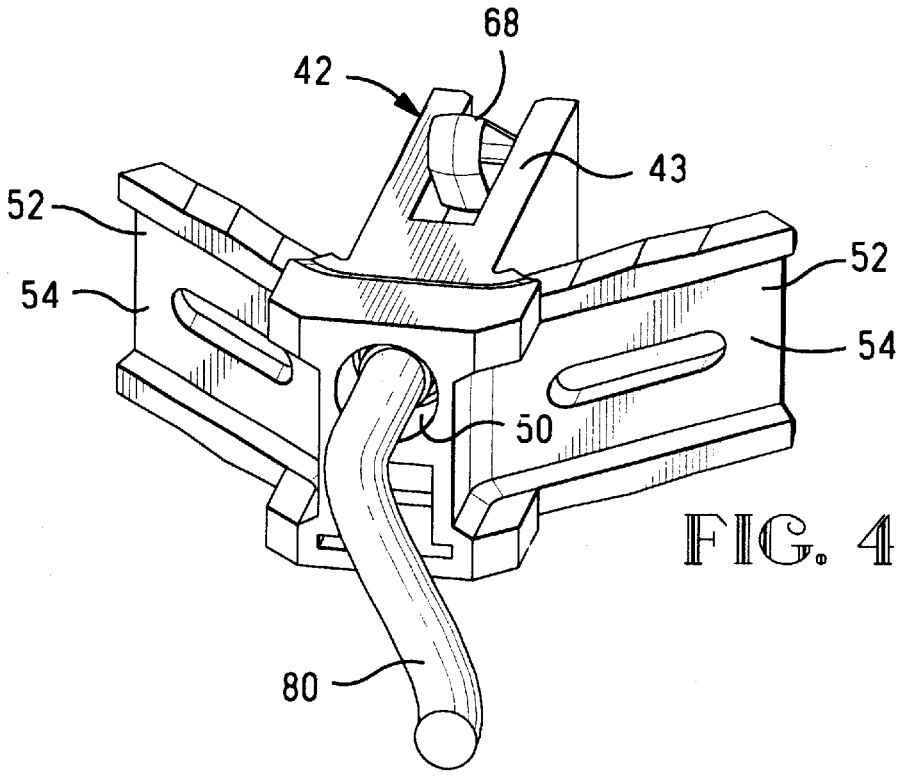
FIG. 4
FIG. 5
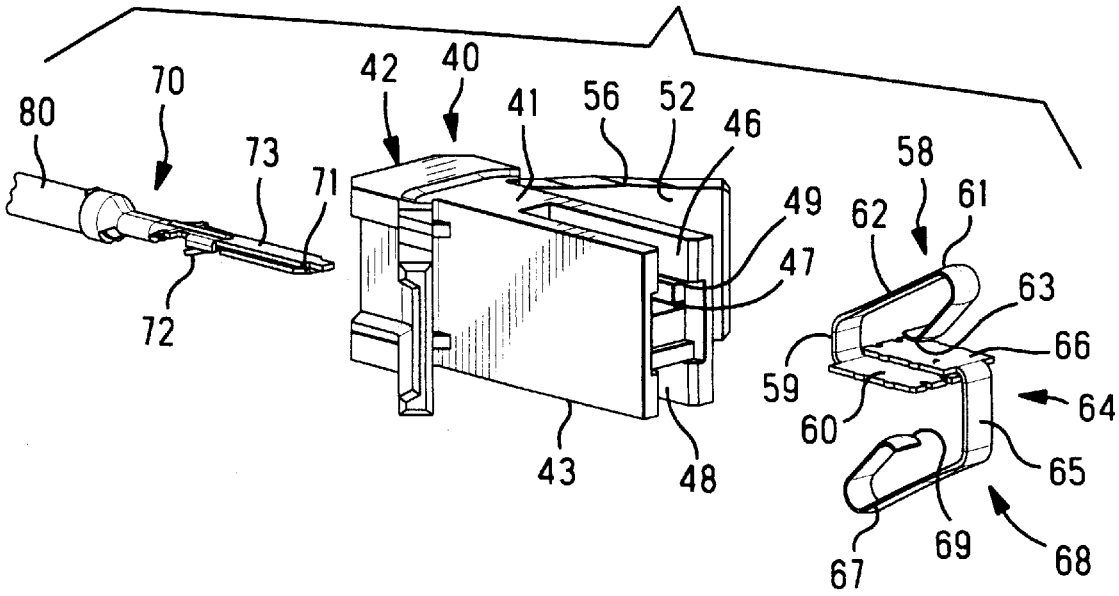

ELECTRICAL CONNECTOR AND PANEL ASSEMBLY

FIELD OF THE INVENTION

The present invention relates to the field of electrical connectors and more particularly to connectors used against two panels and the resulting assembly.

BACKGROUND OF THE INVENTION

For purposes of illustration, the invention will be discussed with reference to a glass panel door, such as used in a refrigerator or freezer in a grocery store or the like. It is to be understood that the term "freezer door" as used herein also includes refrigerator doors. It is to be further understood that the use of the connector is not limited to doors. For example, the invention is also suitable for use in windows for pools, or other areas subjected to wide temperature and moisture conditions.

Glass refrigerator and freezer doors typically are made from two pieces of glass separated by air or other insulating gas. A common problem associated with such glass doors is that moisture condenses on the outside glass owing to warm humid air striking the cold glass. This makes it difficult, if not impossible, for the customers to see what is in the refrigerator or freezer without holding the door open, which results in increased use of electricity for maintaining the desired temperature in the freezer or refrigerator. The prior art method now being used to minimize the condensation is to dispose a conductive element or film on the inside of the front glass, solder leads of a power cable to ends of the element or film and continually heat the outer glass, whether or not the ambient conditions are warm and humid. Additionally, should the glass be broken in the area of the electrical connections, the circuit to the glass remains active, possibly causing a safety hazard.

It is desirable, therefore, to have a system for warming the outer glass that senses when there is moisture on the glass and activated the heating element or film only for a sufficient time to dry the glass. Additionally it is desirable to have a system that will automatically deactivate the heating element if one or the other of the glass layers breaks in the area of the electrical connections to the element or film.

SUMMARY OF THE INVENTION

The present invention is directed to an electrical connector and a panel system that eliminate problems associated with the prior art. An electrical interlock connector for interconnecting a power source to an electrical unit within an apparatus includes an insulating housing containing at least one terminal-receiving cavity with an electrical terminal disposed therein and a first circuit member connected to the power source and attached to the housing. The electrical connector is mountable within the apparatus against portions thereof. The housing has first and second outer surfaces associated with respective portions of the apparatus and with the at least one terminal-receiving cavity in communication with the first outer surface. The terminal has a body portion and a spring section, the spring section having an outer connecting portion and an inner connecting portion with the outer connecting portion being adapted to be electrically connected to the electrical unit. The outer connecting portion resiliently extends outwardly of the first outer surface to an open position wherein the terminal and the first circuit member are electrically disconnected. The outer connecting portion is movable toward the first outer surface and into the cavity to a closed position by a first portion of the apparatus upon mounting the connector in the apparatus against the first portion and a second portion. The connector has a section along the second outer surface that engages the second apparatus portion, the connector section being remote from and relatively movable with respect to the spring section. Whereby the inner connecting portion is at least in electrical connection with the first circuit member only when the connector is against the first portion and the second portion of the apparatus and the terminal is in its closed position thereby interconnecting the power source to the electrical unit. For purposes of discussing the invention, a panel assembly such as a freezer door is the "apparatus" and the electrical circuitry thereon is the "electrical unit".

In one embodiment, the connector section that engages the second apparatus portion is a second terminal that is disengaged from the circuit member unless biased by the second apparatus portion. The second terminal is disposed in a second terminal-receiving cavity. The second terminal has a body portion and a spring section, the spring section having an outer connecting section and an inner connecting section, the outer connecting section resiliently extending outwardly from the second outer surface of the housing to an open position. The outer connecting portion is movable toward the second outer surface and into the second cavity to a closed position by the second portion of the apparatus such that the inner portion of the second terminal electrically engages the first circuit member and concomitantly therewith the first apparatus portion moves the inner connecting portion of the terminal in the first cavity into electrical engagement with the body of the second terminal.

In another embodiment of the invention, the connector section is the second outer surface of the housing. The housing in this embodiment of the electrical interlock connector is freely slidable within a frame in a direction perpendicular to the first outer surface from a first position to a second position, when the outer connecting portion of the terminal is moved to the closed position, the inner connecting portion is brought into engagement with the first circuit member, so that only when both the housing is in the first position and the terminal is in the closed position is the terminal in electrical engagement with said the circuit member.

In a further embodiment of the invention, the connector section is the second outer surface of the housing that engages the second apparatus portion. Upon mounting the connector against the first and second apparatus portions, the spring section and the second housing surface are moved toward one another until the outer connecting portion is engaged with the electrical unit and the inner connecting portion electrically engages the circuit member.

In another embodiment of the invention, the connector section includes another spring section at an opposite end of the terminal body and an insulating actuation member mounted within the housing proximate the terminal. The second spring section has an outer connecting portion that resiliently extends outwardly of the second outer surface of the housing and an inner connecting portion that is adapted to electrically engage the circuit member upon moving the terminal to its closed position. The insulating member includes an elongate portion that extends along the outer connecting portion of the another spring such that the elongate portion is between the second apparatus portion and the outer connecting portion. Upon mounting the connector against respective the apparatus portions, the elongate member and the outer connecting portion are simultaneously moved toward the second outer surface with the inner connecting section engaging the circuit member when the terminal reaches its closed position.

The invention is also directed to a panel Assembly including first and second panels, at least one of which includes an electrical circuit thereon having first and second conductive areas, each area being electrically connected to a power source by connectors made in accordance with the invention.

Embodiments of the invention will now be described by way of example with reference to the accompanying drawings.

BRIEF DESCRIPTION OF THE DRAWINGS

FIG. 4 is an isometric view of the connector of FIG. 3 as viewed from the outer end.

FIG. 5 is an exploded view of the connector of FIG. 3.

DETAILED DESCRIPTION OF AN EMBODIMENT OF THE INVENTION

Figure 1:
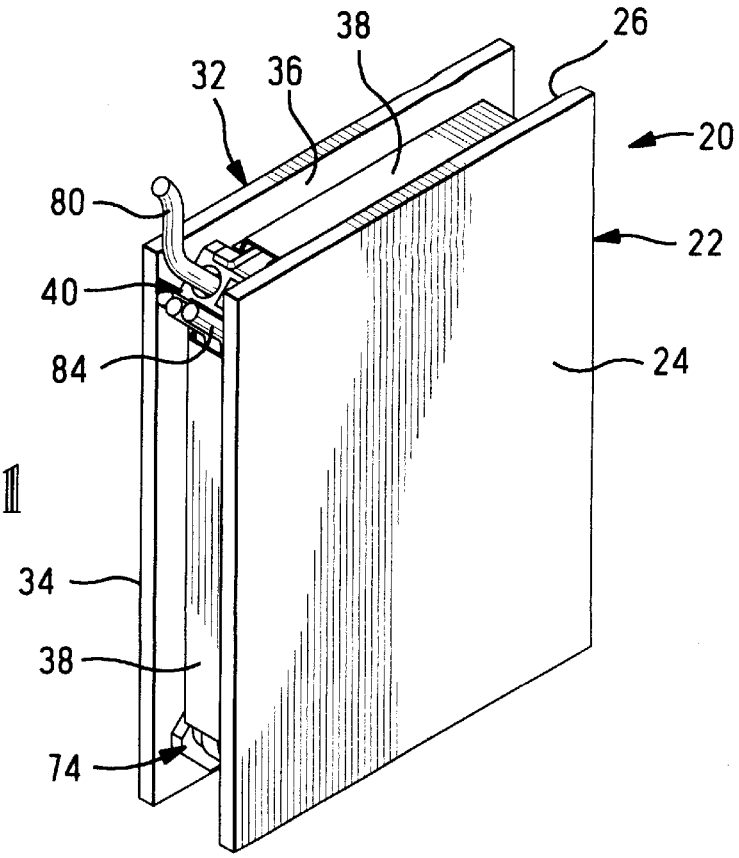
FIG. 1 is an isometric pictorial representation of a panel assembly made in accordance with the present invention.
Figure 2:
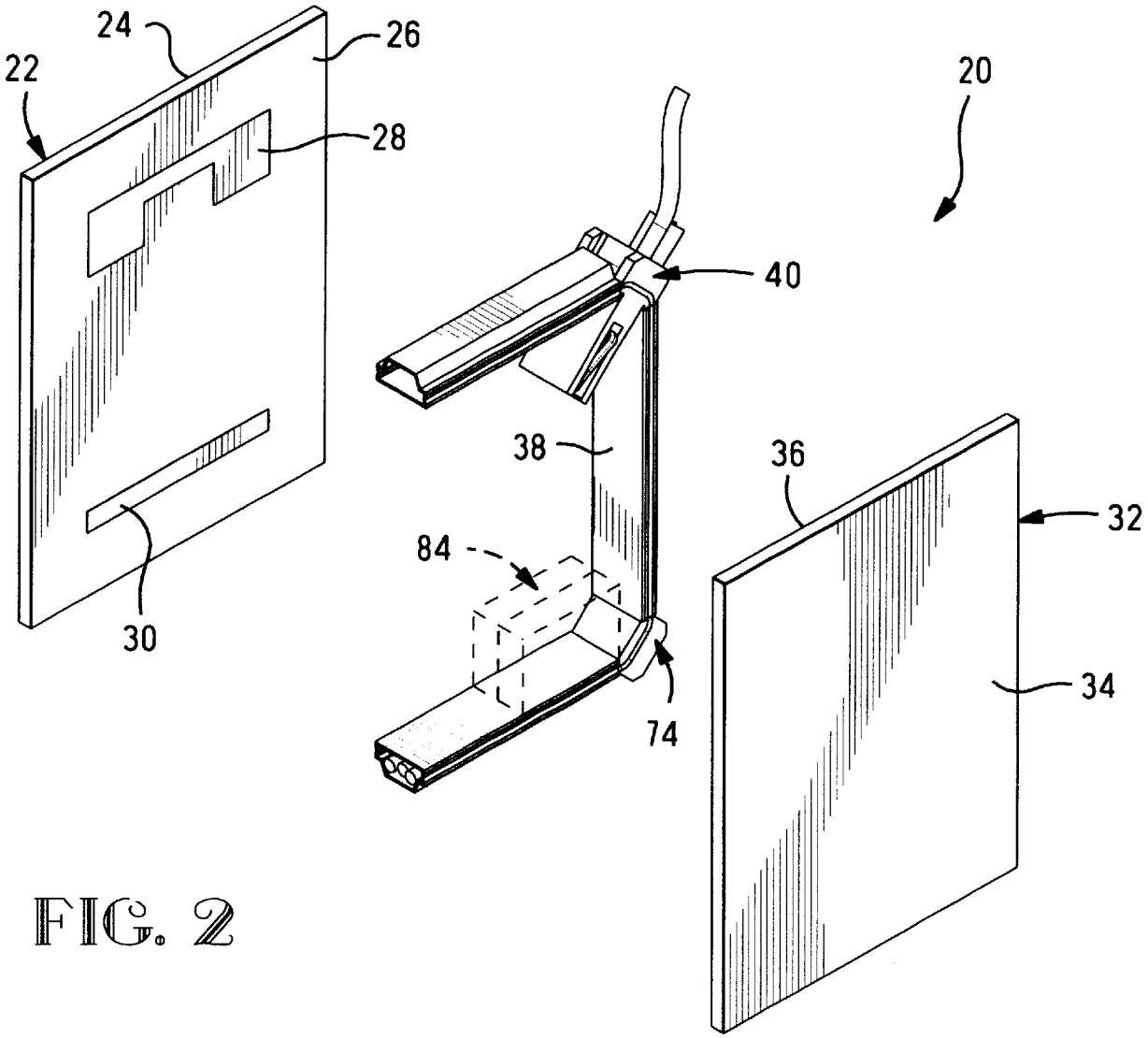
FIG. 2 is an exploded pictorial representation of the assembly of FIG. 1.

Referring first to FIGS. 1 and 2, assembly 20 includes a first or front panel 22 and a second or back panel 32 secured together and spaced a selected distance apart by a frame having spacer strips 38 that extend around and between the inner surfaces 26, 36 of the panels 22, 32. For purposes of illustration, assembly 20 will be described in terms of a glass freezer door assembly with the outer surface 24 of first panel 22 being the side of the door that is exposed to ambient conditions and the outer surface 34 of second panel 32 being the side of the door that is exposed to the colder temperature. For purposes of clarity in understanding the invention, the spacer strips 38 are shown out of proportion with respect to the door panels 22, 32. Typically the spacers are on the order of ½ inch thick while the doors or other panels are considerably larger and are usually measured in feet.

In the embodiment shown, the inner surface 26 of the first or front panel 22 includes a resistive coating and two conductive areas or traces 28, 30 proximate opposite edges thereof as shown in FIG. 2. Upon connecting respective conductors 80, 82 (shown in FIG. 13) to the traces 28, 30 the coating can be energized to warm the front panel 22 to prevent an accumulation of moisture on the exposed outer surface 24 thereof. It is to be recognized that the invention is not limited to the use of a resistive coating and that other circuitry may be used to provide the same function. Additionally, it is to be recognized that for ease of manufacturing and limiting inventory, it may be desirable to use the same coated panel for both the front and back of the assembly. When the panel assembly is a freezer door or the like, it is to be recognized that the rear panel would not be warmed.

Figure 10:
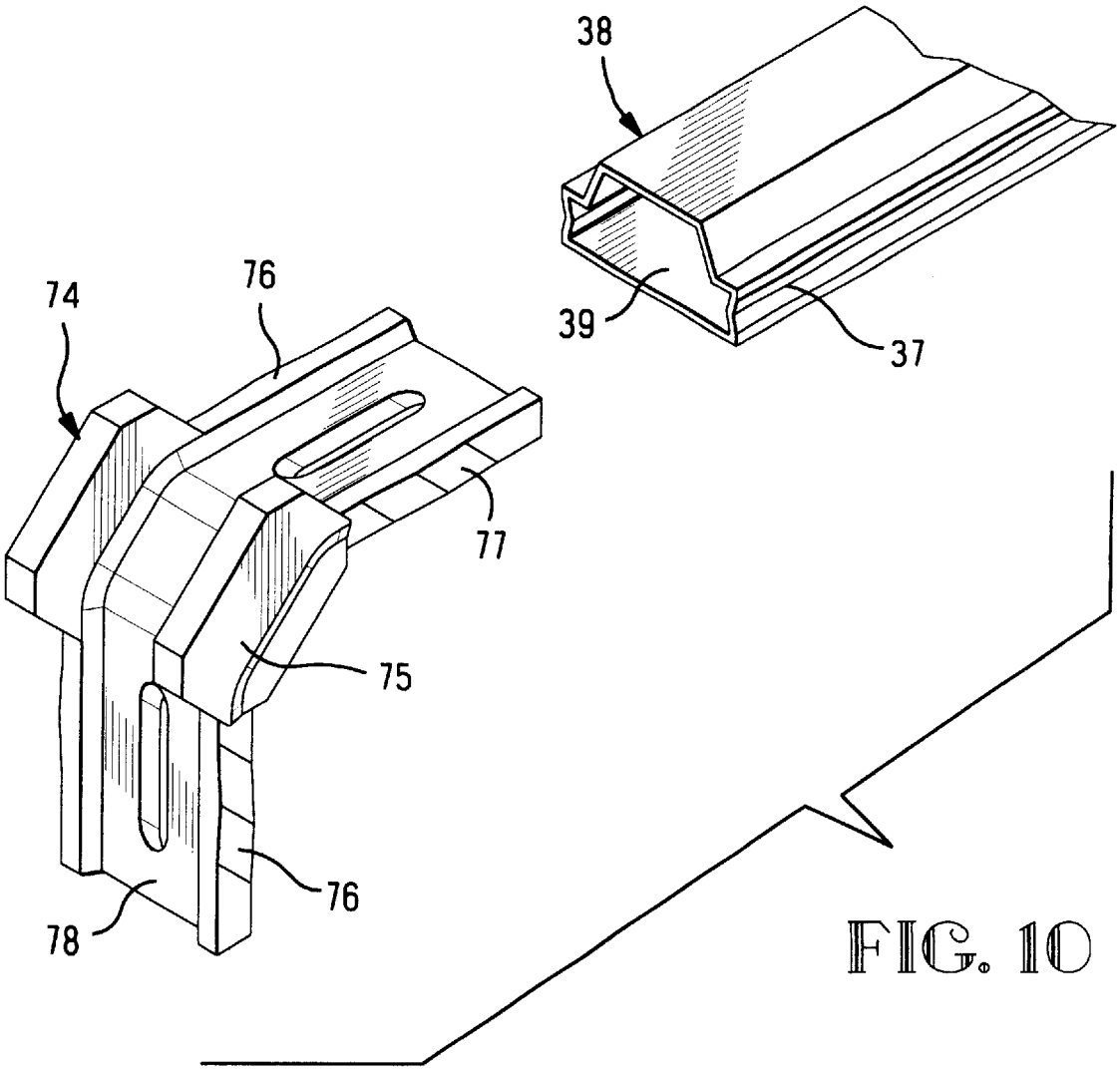
FIG. 10 is an isometric view of a corner member with a spacer strip exploded therefrom.
Figure 11:
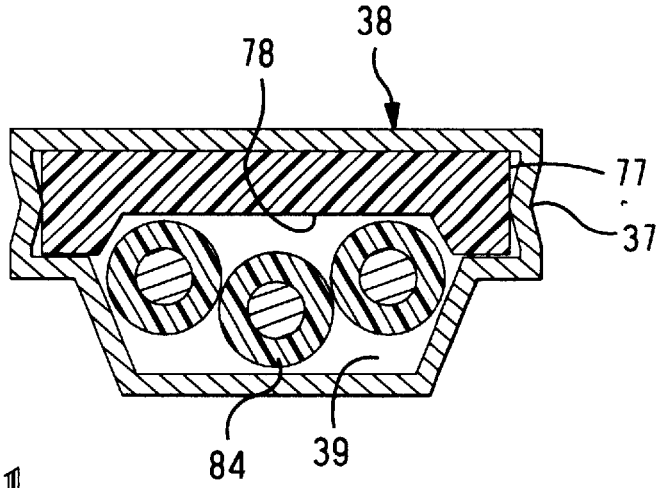
FIG. 11 is a cross-sectional view of the corner member and a plurality of conductors disposed in a channel of the spacer strip.

Spacer strips 38 define a conductor receiving channel 39 for receiving conductors 84, as best seen in FIGS. 10 and 11. In the embodiment shown in FIGS. 1 and 2, the spacer strips 38 are joined together at the upper left hand corner of assembly 20 by electrical connector 40 and at the other three corners by corner members 74. For purposes of clarity, two of the corners 74 and a spacer 8 have been omitted from the drawing. FIG. 2 also shows an electronic module 86 in phantom that may be used in the assembly of the invention as more fully explained below. In the arrangement shown, the door is designed to include hinges on its left hand side. It is to be understood that connector 40 can be used in a right hand corner and the door include hinges on its right hand side.

Referring now to FIGS. 3 through 7, connector 40 includes insulating housing 42, a first or front panel engaging terminal 58, and a second or back panel terminal 64 secured therein. Housing 42 includes a terminal-receiver body 44 having first and second outer surfaces 41, 43, a first terminal-receiving cavity 46, a second terminal-receiving cavity 48 separated by inner wall 45, and a circuit member-receiving passageway 50 adapted to receive first circuit member 70 terminated to conductor 80, which in turn is connected to the power source (not show). Passageway 50 extends into and along the lower surface of second terminal-receiving cavity 48. Housing 42 further includes retention portions 52 extending outwardly therefrom and having edges 56 thereof dimensioned to be received in an interference fit in portions of respective channels 39 of spacer strips 38 when the door is assembled, as shown in FIG. 10.

Retention portions 52 include a recess along the outer sides thereof for receiving conductors 84 therein upon assembly of the door. As can be seen from these Figures, the retention portions extend at an angle to the terminal-receiving body 44 and at a right angle with respect to each other. Connector 40 is designed so that it may be used in either a right or a left handed door or panel assembly. Additionally, housing 42 is designed so that it may be molded in a single action mold thereby permitting cost effective manufacturing.

Figure 7:
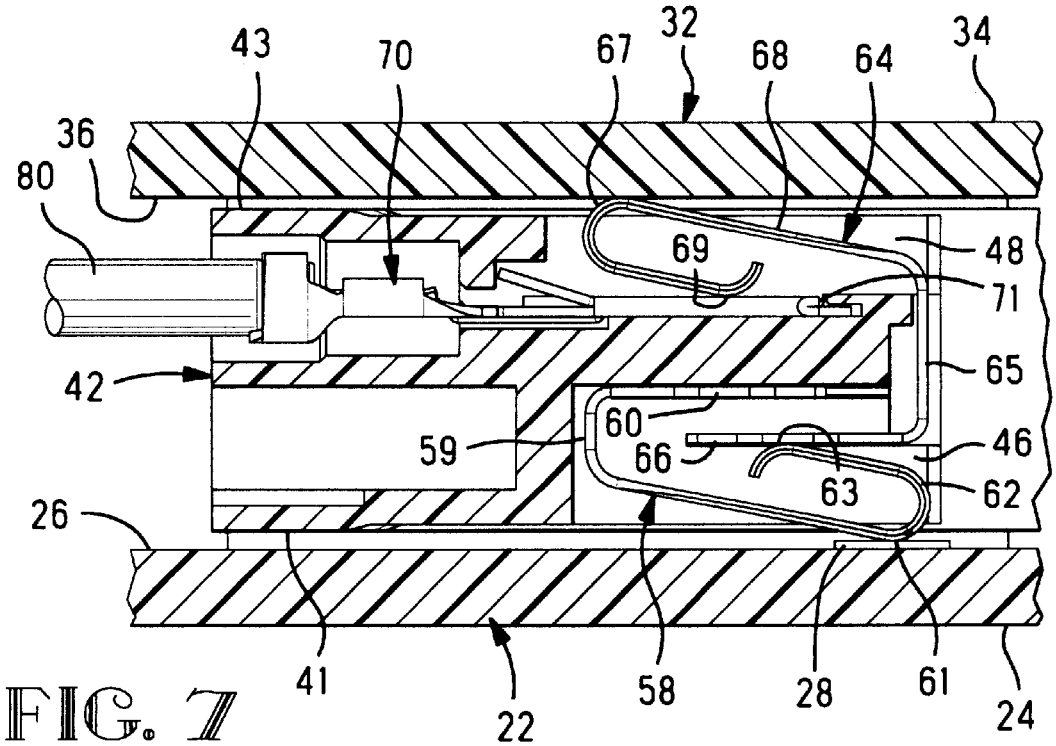
FIG. 7 is a view similar to that of FIG. 6 with the panels assembled on both sides of the connector.

First and second terminals 58 and 64 are similar in structure. First terminal 58 includes flat body portion 60 and a spring section defined by a U-shaped spring arm 62 joined to body portion 58 by bight 59. Spring arm 62 includes an outer connecting portion 61 proximate the base of the "U" engaging the trace 28 on a first apparatus portion or front panel surface 26, and an inner connecting portion 63 at the leading end of the arm 62 for engaging second terminal 64. Second terminal 64 includes body portion 66 and a spring section defined by a U-shaped spring arm 68 joined to body portion 66 by bight 65. Spring arm 68 includes An outer connecting portion 67 proximate the base of the "U" for engaging a second apparatus portion or the inner surface 36 of back panel 32, and inner connecting portion 69 at the leading end of the arm 68 for engaging first circuit member 70, when the door is assembled as can be seen in FIG. 7. If connector 40 is being used in a door assembly that uses identical front and back panels, it will be necessary to provide some insulation between second outer connecting portion 69 and inner surface 36 of panel 32. The insulation is not necessary for a back panel that does not have a conductive coating.

Figure 3:
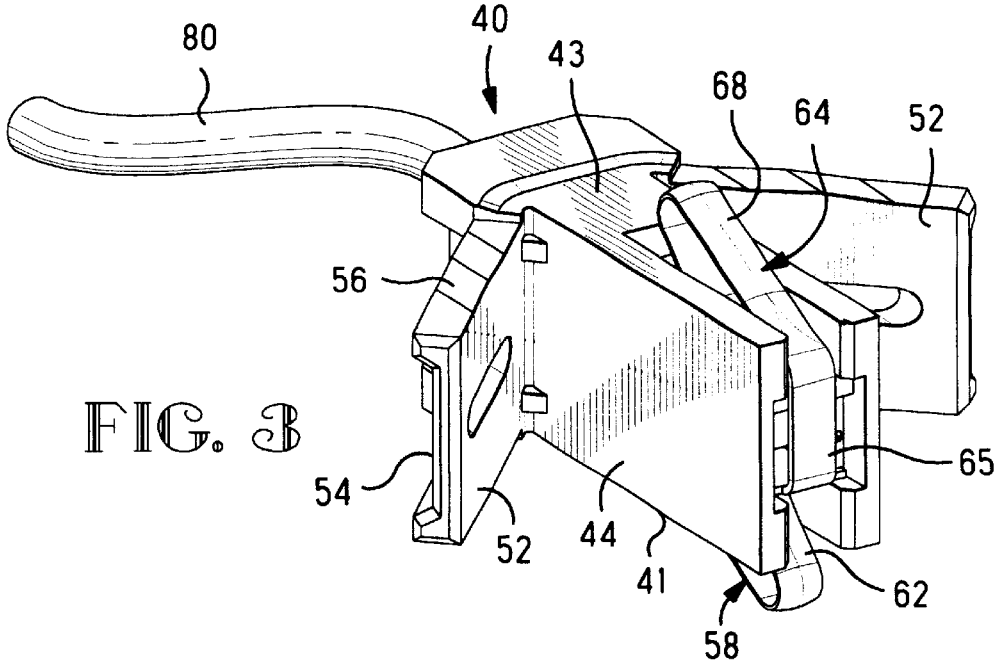
FIG. 3 is an isometric view of a connector made in accordance with the invention as viewed from the inner end.
Figure 6:
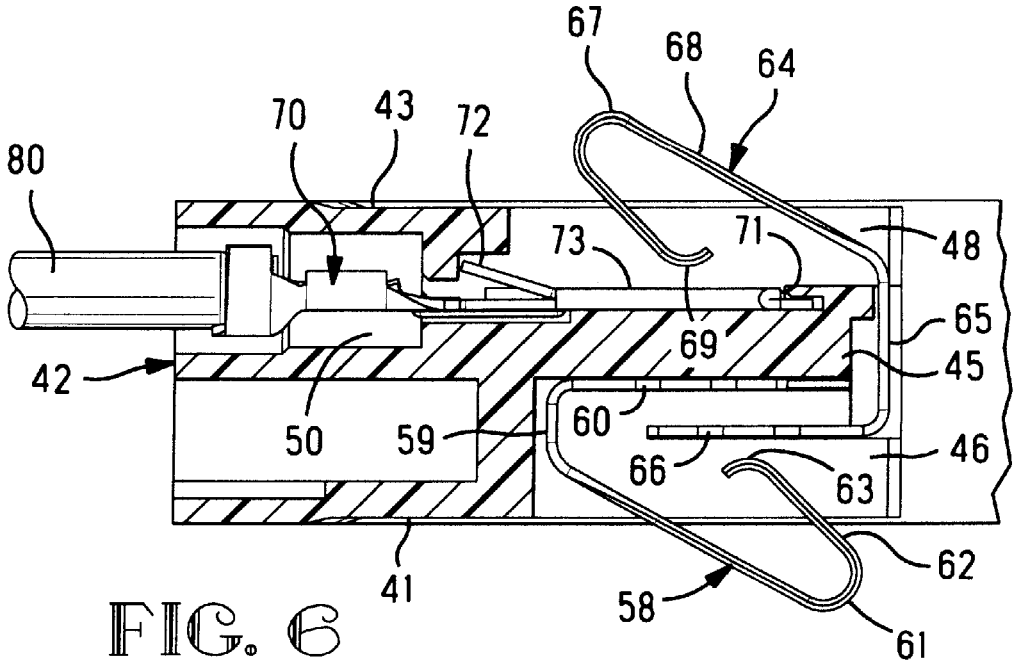
FIG. 6 is a fragmentary cross-sectional view of the connector of FIG. 3 prior to assembling the panels thereto.

First and second terminals 58, 64 are assembled in terminal-receiving body 44 by first inserting bight 59 of first terminal 58 into first terminal-receiving cavity 46 such that body portion 60 is secured in slot 47 and spring arm 62 is in cavity 46, ax best seen in FIGS. 5, 6, and 7. The body portion 66 of back or second terminal 64 is then inserted into slot 49 of the first terminal-receiving cavity 46 and the spring arm 68 is concomitantly moved into the second terminal-receiving cavity 48 with bight 65 extending around the outer edge of inner wall 45 between the two cavities 46, 48. As best seen in FIGS. 3, 4 and 6, the spring arms 62, 68 and first and second outer connecting portions 61, 67 resiliently extend outwardly from the respective first and second surfaces and the corresponding cavities 46, 48 to an open position. Circuit member 70 includes a tab portion 73 having a leading end 71 that is trapped in slot 51 within cavity 48 and a retention lance 72 that engages surface 53 along the base of cavity 48.

Figure 13:
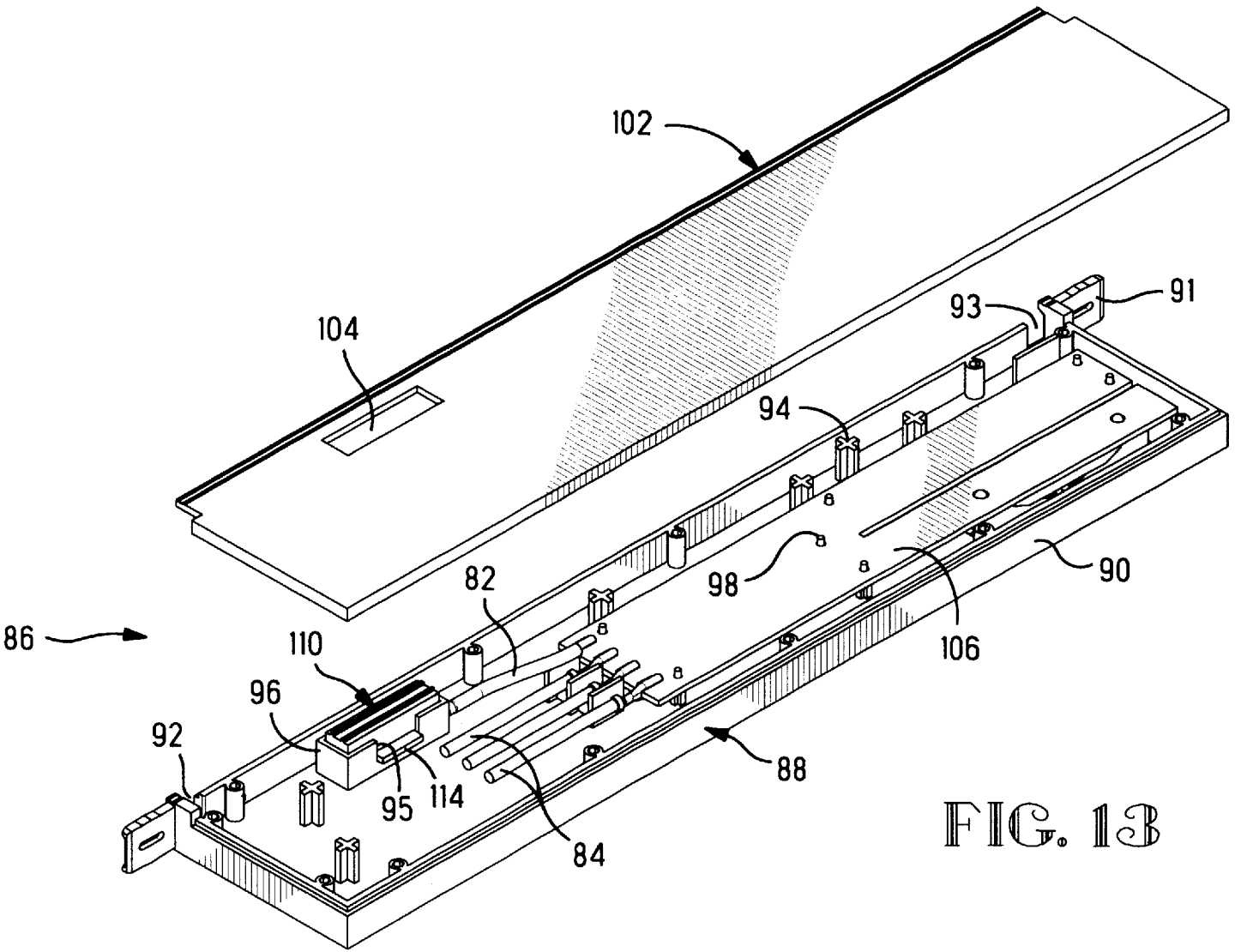
FIG. 13 is an exploded view of an electronic module of FIG. 12 with the cover exploded therefrom and a connector therein.
Figure 14:
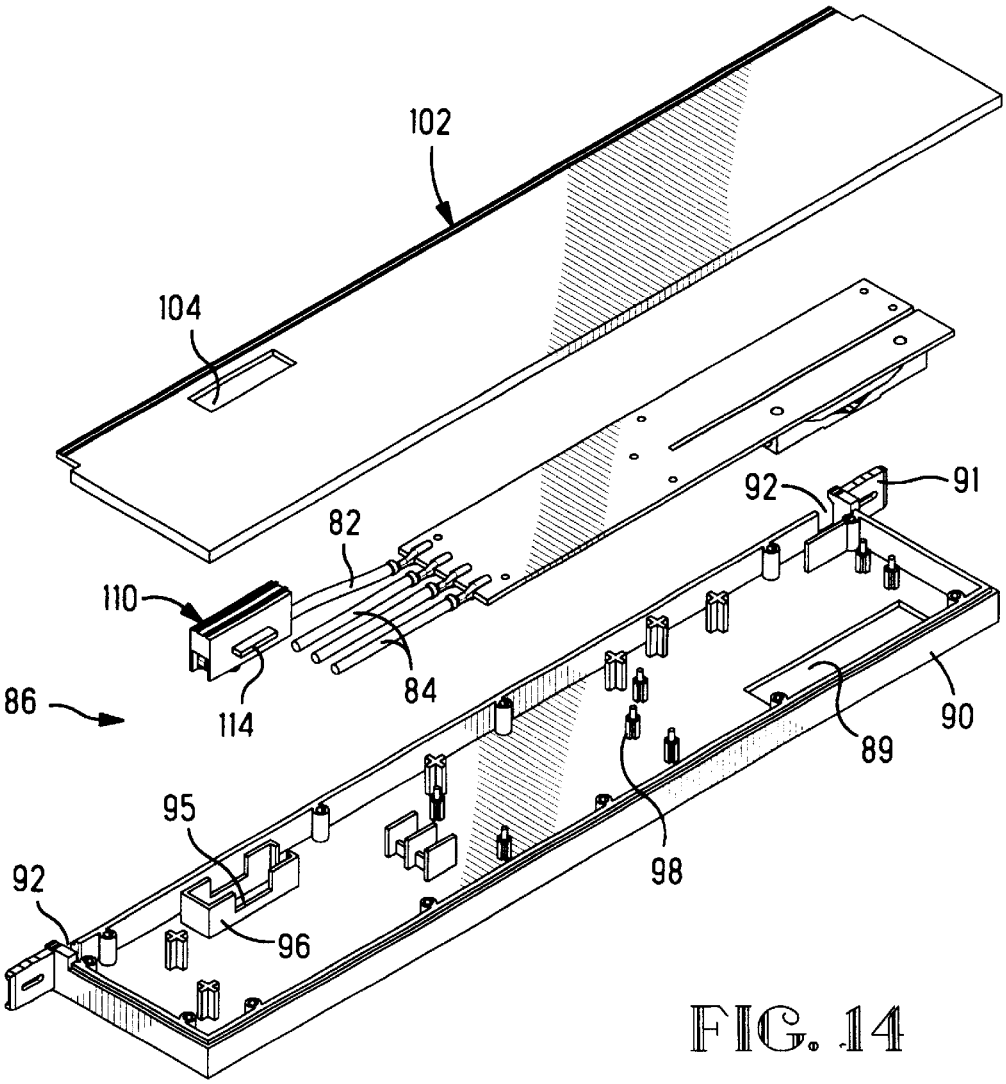
FIG. 14 is a view similar to FIG. 13 with the connector exploded therefrom.

Prior to attaching the panels 22, 32 along outer surfaces 41, 43 of the connector 40, first circuit member 70 is inserted into and secured in circuit member-receiving passageway 50 with tab section 73 extending into second cavity 48, as described above. Upon assembling the door with the panels in a first posit-on, the first apparatus portion or surface 26 of front panel 22 engages and compress the spring arm 62 of first terminal 58 moving arm 62 toward surface 41 and into cavity 46, thereby bringing the outer connecting portion 61 into engagement with trace 28 on front panel surface 26 and the inner connecting portion 63 into engagement with body 66 of second terminal 64. Concomitantly therewith the second apparatus portion or surface 36 of back panel 32 compresses the spring arm 68 of the second terminal 64 moving arm 68 toward second surface 43 and into cavity 48, thereby bringing outer connecting portion 69 thereof into engagement with tab portion 73 of first circuit member 70, which is connected to the power source (not shown) by conductor 80 shown in FIG. 7. When power is supplied to the assembly, current travels through first circuit member 70, second terminal 64 to first terminal 58 and to trace 28 of front panel 22, through the resistive coating of the panel and through another conductor 82 terminated to trace 30 on surface 26, as best seen in FIGS. 13 and 14.

In the event one of the panels 22, 32 moves to a second position, that is the panel is removed or the glass is broken, while the system is energized, the circuit path is automatically broken by the connector. For purposes of this disclosure the term "removed" as applied to one of the panels is to be understood to include breaking of the panel. Typically, glass used for freezer doors is the kind that shatters when it breaks, thus it is "removed" from the assembly.

Figure 8:
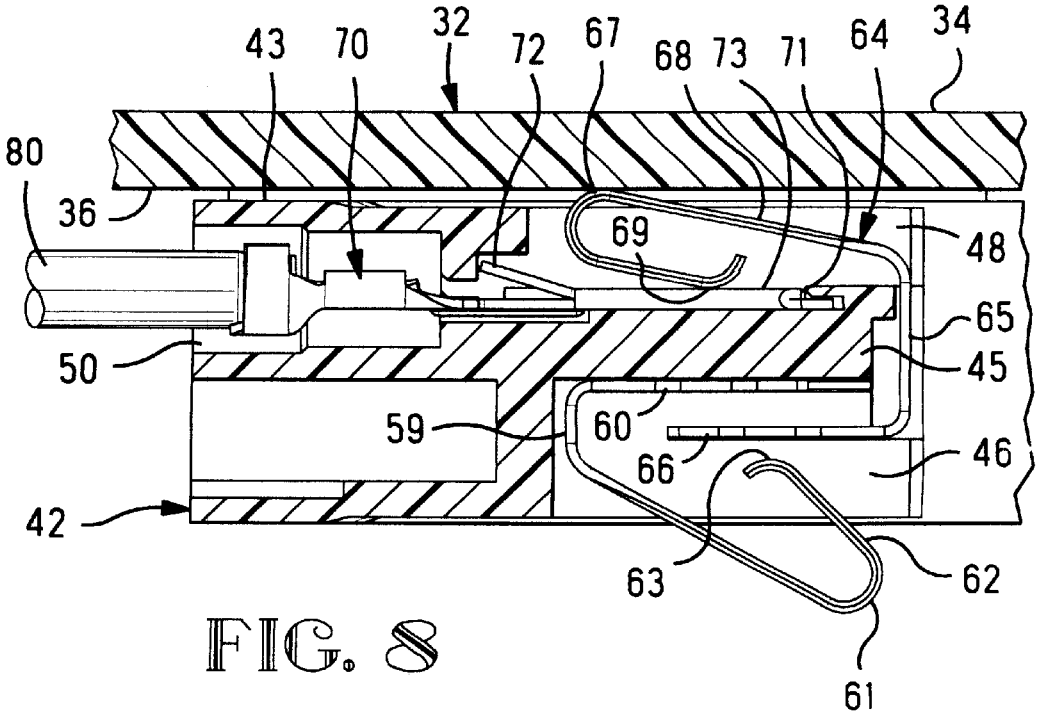
FIG. 8 is a view similar to that of FIG. 6 with the front panel removed and illustrating the opening of the circuit.
Figure 9:
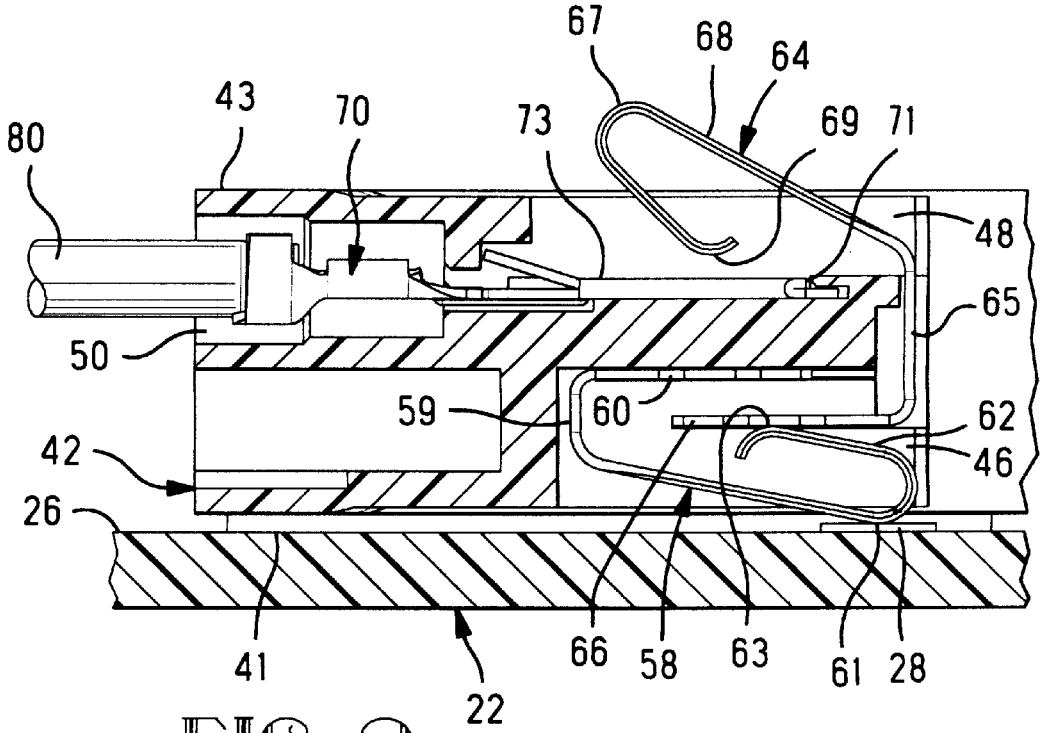
FIG. 9 is a view similar to that of FIG. 6 with the back panel removed and illustrating the opening of the circuit.

The automatic breaking of the circuit is best understood by referring to FIGS. 8 and 9. If the front panel 22 is removed, the compressive force against spring arm 62 is no longer present thus allowing spring arm 62 to resile outwardly thereby breaking electrical connection between inner connecting portion 61 and second terminal body 66 and returning to the position shown in FIG. 8. If, on the other hand, the rear panel 32 is removed, compressive force against spring arm 68 of second terminal 64 is released and arm 68 resiles outwardly thus breaking the connection between inner connecting portion 69 and first circuit member 70, as shown in FIG. 9.

FIGS. 10 and 11 show the structure of corner member 74 having an angled center portion 75 and retention portions 76 extending outwardly from center portion 75. The retention portions 76 are at a right angle with respect to each other. The center portion 75 and retention portions 76 define a conductor-receiving recess 78 extending along the outer surface of the corner member for receiving conductors 84 therealong. The base of the recess 78 includes a slot 79 provide some resiliency to portion 76 for ease of insertion into conductor-receiving channel 39 of spacer strip 38. Edges 77 of retention portions 76 are configured to provide an interference fit in portion 37 of the conductor-receiving channel 39 of spacer strip 38, as best seen in FIG. 11. The retention portions 76 are configured in the same manner as those of connector 40, thus making any corner member 74 interchangeable with connector 40. FIG. 11 further illustrates three conductors 84 disposed in channel 39. It is to be understood that the number of conductors 84 will vary depending upon the desired electrical needs of the assembly. If a panel is removed or broken, it also is desirable, for purposes of safety, that the same or a similar type of interlock connector or other circuitry be provided that would automatically assure power is turned off at the connection to second trace 30.

In addition to providing the capability of warming the outer panel of a freezer door or the like to minimize condensation of moisture thereon, it further is desirable that the assembly 20 have the capability to sense when moisture is beginning to condense and to activate the warming circuitry only when needed. The ability of the assembly 20 to turn the electrical unit on and off results in a saving of electrical energy and is more cost efficient than the prior art door assemblies.

FIGS. 2, and 12 through 19 show a module 86 that may be used to house electronic circuitry for sensing moisture or other information and turning the power off and on as needed. In the embodiment shown module 86 is disposed proximate the bottom trace 30 on surface 26 of panel 22. Module 86 includes a two part housing 87 having a base 88 and cover 102, a second connector 110 adapted to engage the second trace 30 on panel surface 26 and a circuit board 106 having electronic components 108 thereon. Base 88 includes walls 90 having conductor or wire entrances 92, 93 therein for receiving conductors 84 therethrough for connection to circuit board 106 and retention portions 91 extending outwardly therefrom for attachment to ends of corresponding spacer strips 38, as shown in phantom in FIG. 2. Base 88 further includes connector frame 96 dimensioned to receive connector 110 therein.

Connector 110 includes an insulating housing 112 having first and second outer surfaces, 111, 113. Support shoulders 114 extend outwardly from side walls 115 of the housing 112. Housing 112 is dimensioned to be received within frame 96 with shoulders 114 extending through recesses 95 in side walls of frame 96. Housing 112 is freely slidable in a direction perpendicular to the first surface 111 from a first position to a second position Housing 112 further includes terminal-receiving cavity 116 and slot 117 for receiving panel engaging terminal 120 therein and circuit member-receiving passageway 118 for receiving circuit member 130 therein, as best seen in FIGS. 16 through 19.

Figure 17:
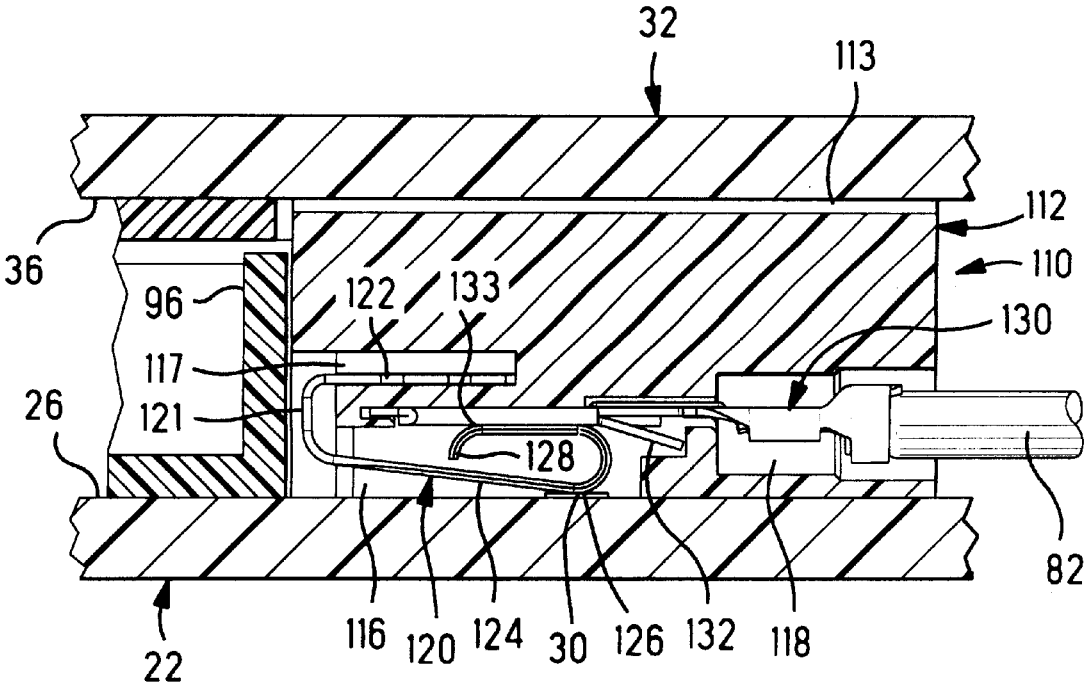
FIG. 17 is a view similar to that of FIG. 16 with the panels assembled on both sides of the connector.
Figure 19:
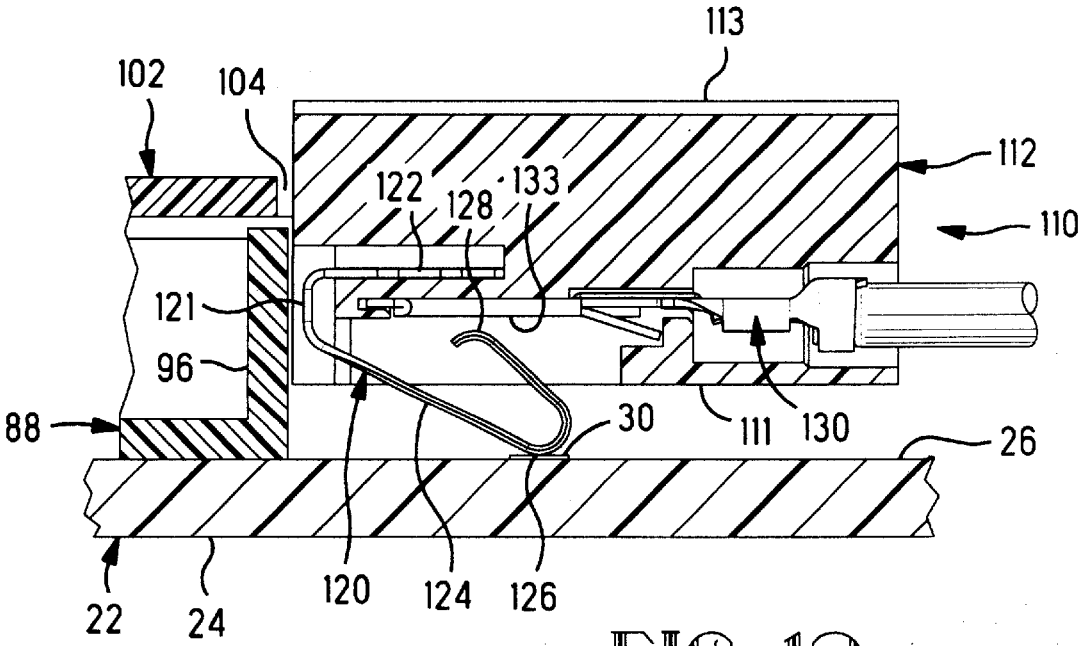
FIG. 19 is a view similar to that of FIG. 16 with the back panel removed and illustrating the opening of the circuit.

Terminal 120 has essentially the same shape as first and second terminals 58, 64 described above. Terminal 120 includes body portion 122 and a spring section defined by a U-shaped spring arm 124 joined to body portion 122 by bight 121. Spring arm 124 includes an outer connecting portion 126 proximate the base of the "U" for engaging the trace 30 on front panel surface 26 and an inner connecting portion 129 at the leading end of the arm 124 for engaging circuit member 130, as shown in FIG. 17. Upon inserting terminal 124 into terminal-receiving cavity 116, spring arm 124 and outer connecting portion 126 thereon resiliently extends outwardly from the first housing surface 111, as seen in FIG. 19. Circuit member 130 connected to a power source via conductor 82 is inserted into circuit member-receiving passageway 118 and secured therein at forward end 131 and by retention tab 132 in the same manner as circuit member 70 in first connector 40.

Figure 16:
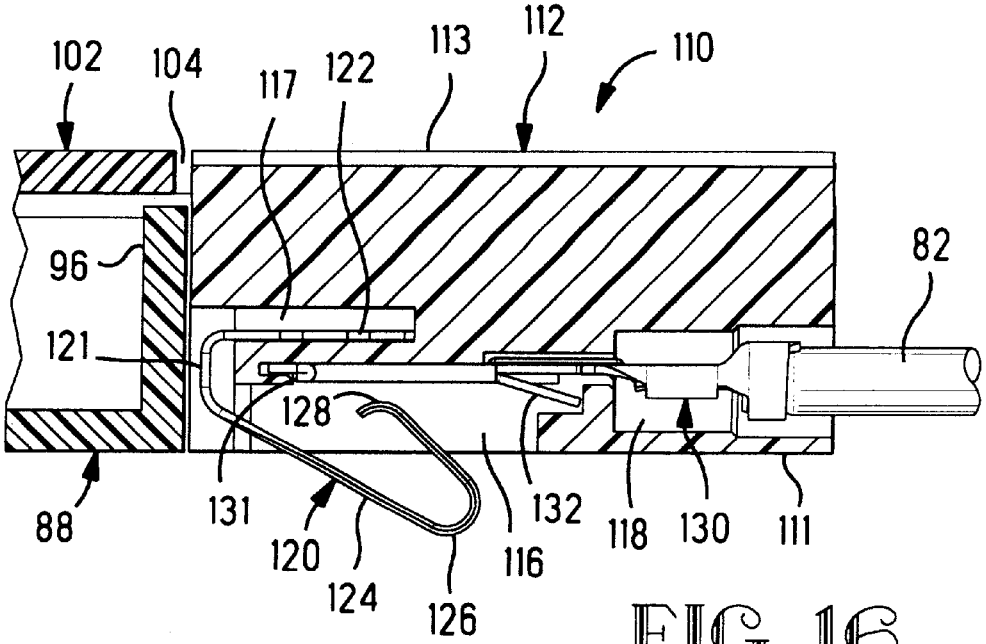
FIG. 16 is a fragmentary cross-sectional view of the connector of FIG. 15 prior to assembling the panels thereto.
Figure 18:
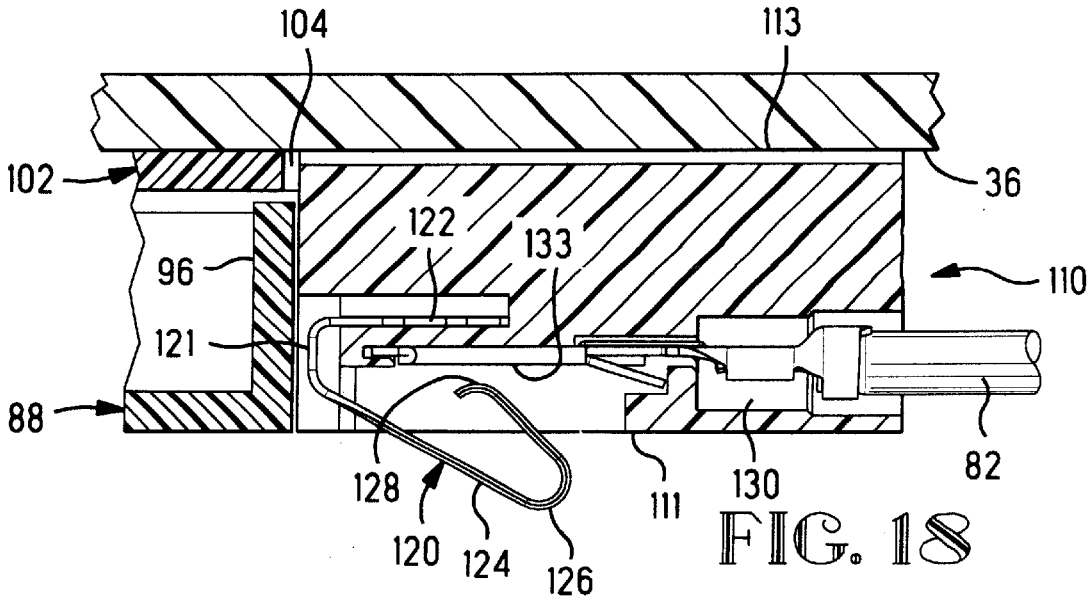
FIG. 18 is a view similar to that of FIG. 16 with the front panel removed and illustrating the opening of the circuit.

Module 86 is assembled by connecting conductors 34 and the other end of conductor 82 to circuit board 106 and placing connector 110 into connector frame 96 in the first position, as shown in FIG. 13. Cover 102 is then secured to base 88. Upon inserting retention tabs 91 into respective ends of spacer strips 38 (not shown) and securing panels 22, 32 together, spring arm 124 is compressed by first apparatus portion such that the outer connecting portion 126 of terminal spring arm 124 engages trace 30 of the electrical unit and the inner connecting portion 128 engages tab 133 of circuit member 130, thereby interconnecting the power source to the electrical unit. FIGS. 16 and 17 illustrate the position of connector 110 in frame 96 before and after panels 22, 32 have been secured together. The second apparatus portion or back panel 32 prevents housing 112 from moving from the first position to the second position in frame 96 owing to the compressive force exerted on spring arm 124 by first apparatus portion or front panel 22 that moved arm 124 into terminal-receiving cavity 116. FIGS. 18 and 19 illustrate the position of connector 110 when the front panel 22 is removed and when back panel 32 is removed, respectively. Upon decreasing the compressive force on spring arm 124 by removal or breakage of front panel 22, spring arm 124 resiles outwardly from first outer surface Ill to an open position, breaking the electrical Connection between inner connecting portion 128 and circuit member 130, as shown in FIG. 18. Upon removal or breakage of back panel 32, the compressive force between second outer surface 113 of housing 112 and panel 32 is removed. Housing 112 including terminal 120 and circuit member 130 then moves to the second position with second housing surface 113 extending outwardly of frame 96 and through opening 104 in cover 102 owing to the force of spring arm 124 as it resiles to its open state, as shown in FIG. 19. Concomitantly therewith the inner connecting portion 128 is disengaged from circuit member 130. The sliding movement or float of the housing 112 is stopped when shoulders 114 engage the inner surface of cover 102 (not shown).

Figure 12:
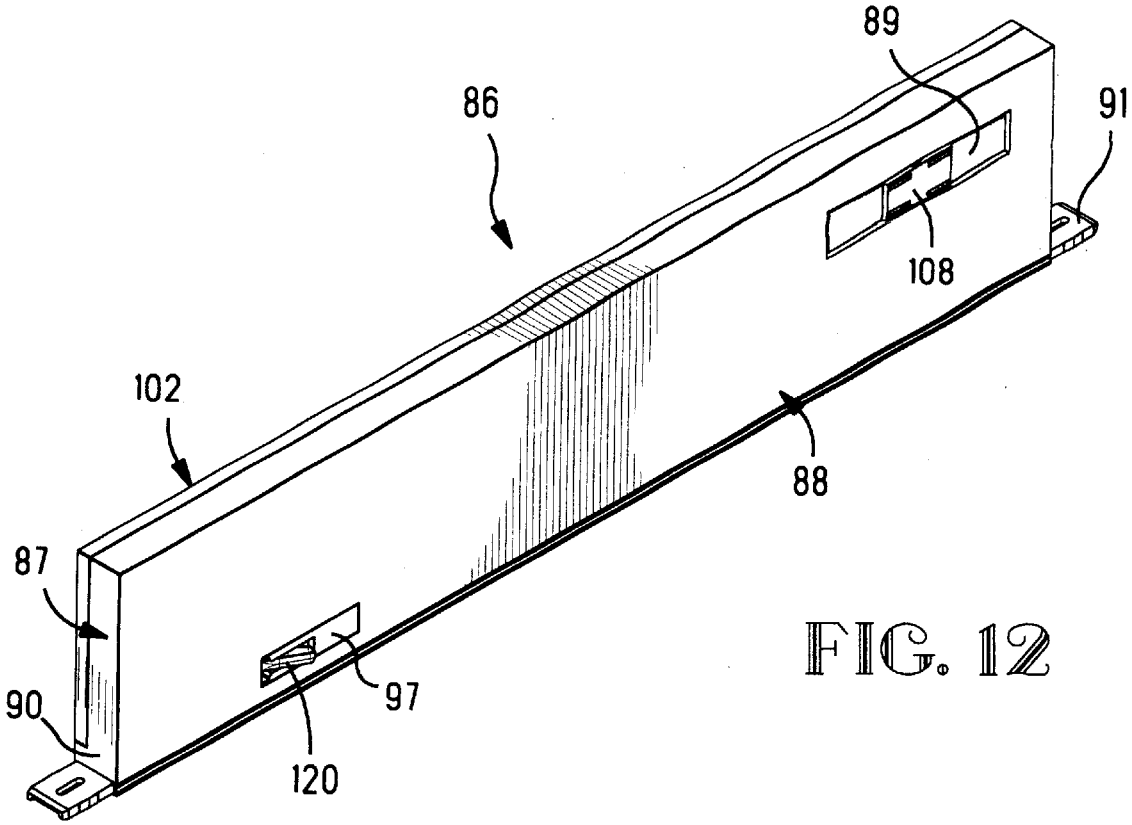
FIG. 12 is an isometric view of an electronic module of the present invention.
Figure 15:
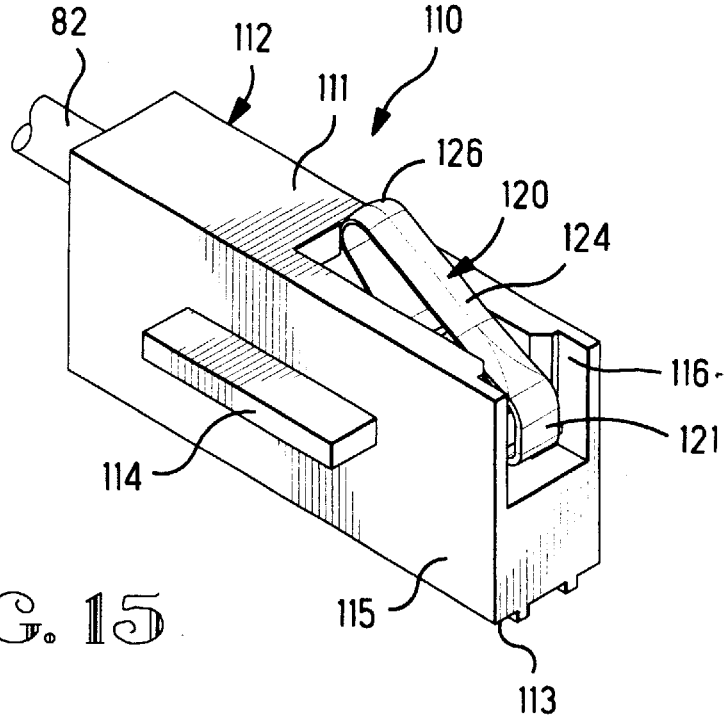
FIG. 15 is an isometric view of the connector of FIG. 13.

As shown in FIGS. 12 and 13, base 88 further includes an opening 89 therethrough for a sensor device 108 or other electronic unit, circuit board supports 98 and a plurality of posts or projections 94 used as conductor guides and to provide strain relief for the conductors 84 being brought into module 86. Module 86 is more fully described in U.S. patent application Ser. No. 09/245,753 filed concomitantly herewith and herein incorporated by reference.

On the other hand, if the warming system is always to remain "on", another interlock connector such as connector 40 may be provided at the lower portion of the door that electrically engages trace 30 instead of the module described above . Alternatively, if the conductive areas or circuit pads of a continuous trace are proximate one another, a single connector housing having two sets of terminals may be used.

Figure 20:
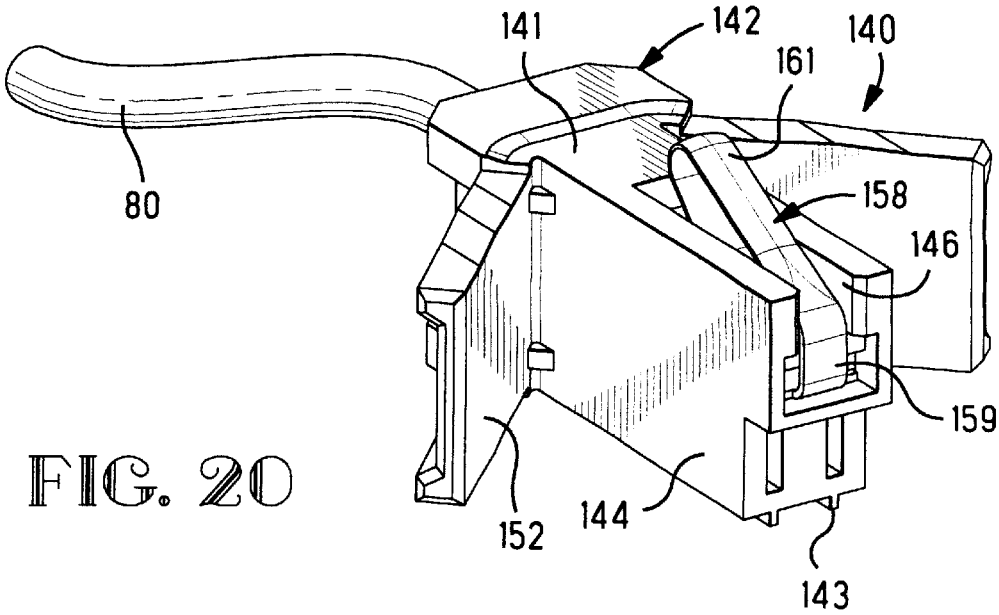
FIG. 20 is an isometric view of an alternative embodiment of a connector suitable for use in the invention.
Figure 21:
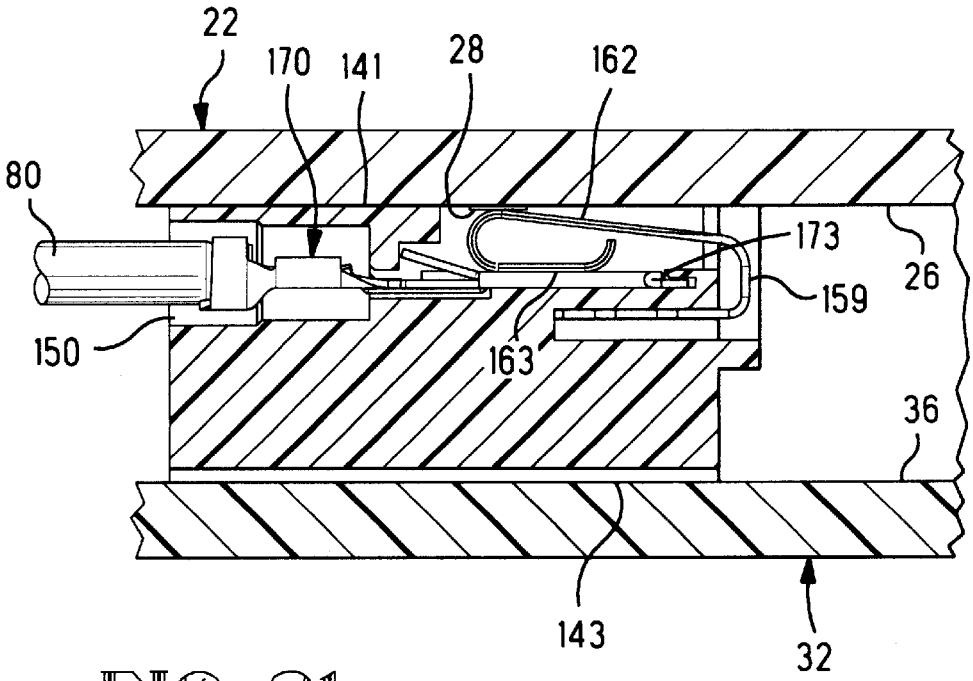
FIG. 21 is a cross-sectional view of the connector of FIG. 20 with the panels assembled on both sides of the connector.
Figure 22:
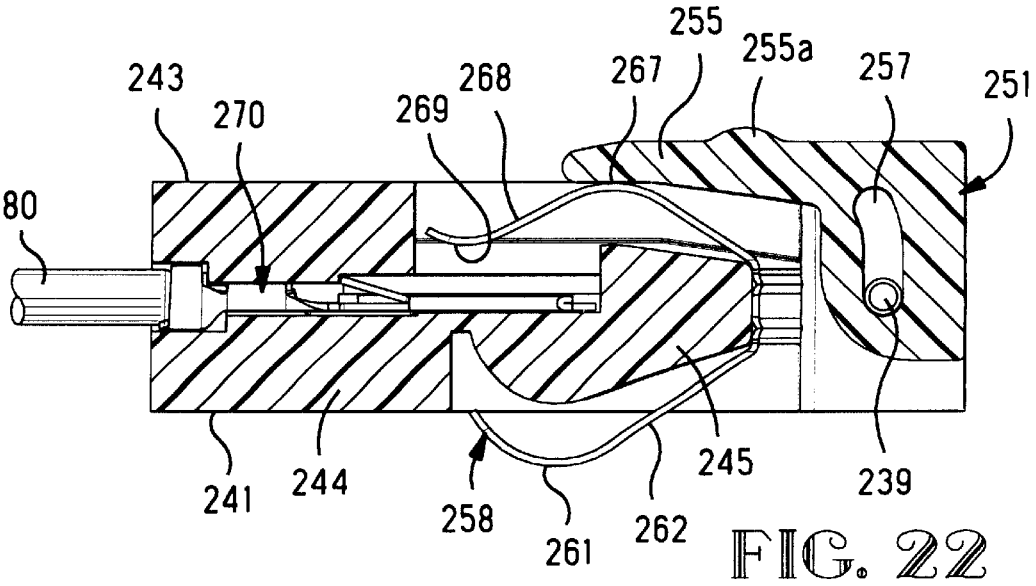
FIG. 22 is a cross-sectional view of another connector embodiment of the present invention prior to assembling the panels thereto.
Figure 23:
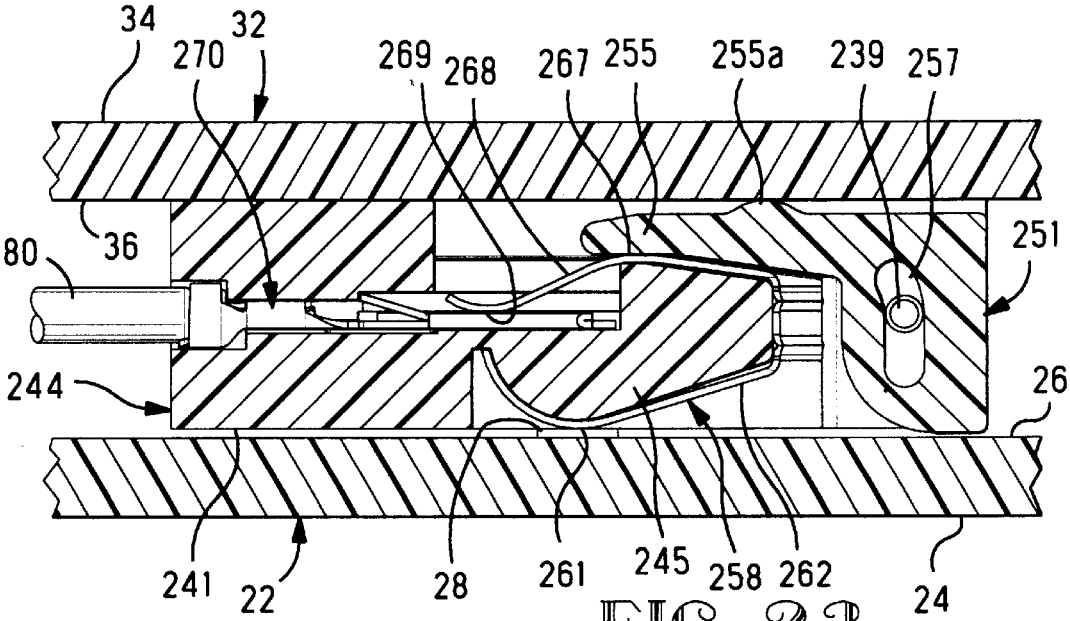
FIG. 23 is a view similar to that of FIG. 22 with the panels assembled on both sides of the connector.
Figure 24:
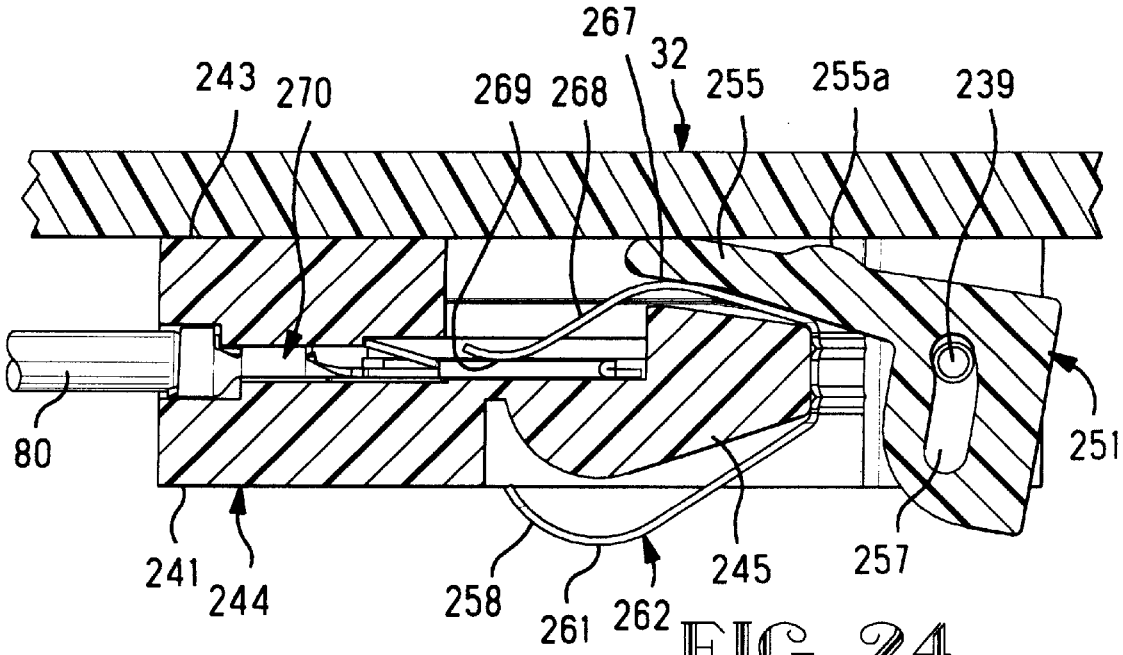
FIG. 24 is a view similar to that of FIG. 23 with one of the panels removed.
Figure 25:
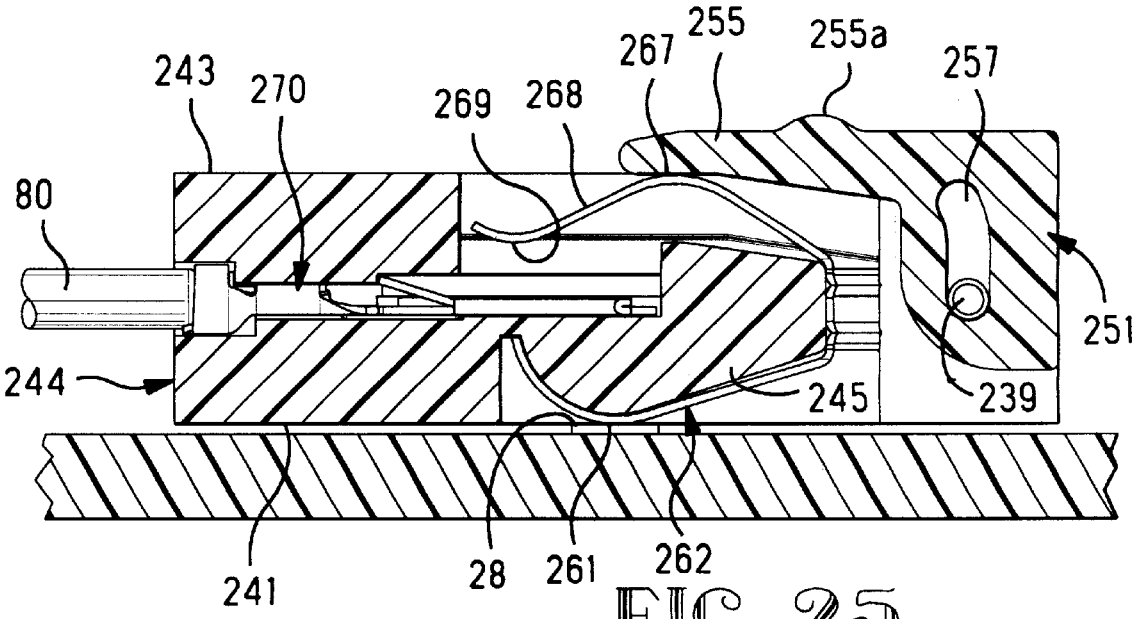
FIG. 25 is a view similar to that of FIG. 23 with the other panel removed.

FIGS. 20 and 21 illustrate an alternative embodiment 140 of a connector made in accordance with the invention. In this embodiment, connector 140 includes an insulating housing 142 having first and second outer surfaces 141, 143 and a first or front panel engaging terminal 158 secured therein. Housing 142 includes a terminal-receiving body 144 and a pair of retention portions 152 like those previously described. Body 144 includes a terminal-receiving cavity 146 and a circuit member-receiving passageway 150. Front panel engaging terminal 158 includes flat body portion 160 and a U-shaped spring arm 162 joined to body portion 160 by bight 159. Spring arm 162 includes a first or outer connecting portion 161 proximate the base of the "U" for engaging the trace 28 of an electrical unit such as front panel surface 26 and a second or inner connecting portion 163 at the leading end of the arm 162 for engaging circuit member 170. In this embodiment the circuit will be broken if the front panel is removed or broken. FIGS. 22 through 25 illustrate a further embodiment 240 of the invention that uses a connector having a single terminal 258 and an insulating member 251 positioned between the front and back panels 22, 32, respectively. The power circuit is broken when either the front or back panel 22, 32 is removed or broken. FIG. 22 illustrates a cross-sectional view of the connector 240 after circuit member 270 has been inserted into the housing 242. Housing 242 having first and second outer surfaces 241, 243 includes a terminal-receiving cavity having portions 246, 248 on both sides of a center wall 245. An L-shaped insulating member 251 is mounted on mounting post 239 proximate the wall 245 at the open end of the passageway portions 246, 248 in a manner to permit movement from an initial position to at least a second position in the embodiment shown, the base 253 of insulating member 251 includes a slot 257 that is dimensioned to slide along mounting post 239 as member 251 is moved. The movement may be translational as illustrated in FIG. 25 or a combination of translational and pivotal as illustrated in FIG. 24. It is to be recognized that other arrangements may be used to mount an insulating member in the connector housing. When the inner surface 36 of back panel 32 includes circuitry thereon in addition to that on the front panel 22 the insulating member 251 eliminates the need to provide an insulating tape or layer on a conductive surface of the back panel.

Terminal 258 is essentially "U"-shaped with each of the first and second arms 262, 268 thereof having rounded sides and defining outer connecting portions 261, 267 thereon. The leading end of the first arm is disposed in the housing passageway 246 with the curved panel-engaging outer connecting portion 261 extending outwardly from housing passageway 246. The leading end of the second arm 268 includes inner connecting portion 269 and is adapted to electrically engage the circuit member 270 when the panels 22, 32 are assembled on both sides of the connector 240. It is to be understood that the leading end of second arm 268 may have a reverse curve, as shown, or other configurations as known in the art. The leg 255 of insulating L-shaped member 251 extends into cavity 248 beyond the outer connecting portion 267 of arm 268. When arm 262 engages conductive trace 28 of panel 22, a raised area 255*a* on insulating leg 255 engages the inside surface of rear panel 32 thus preventing outer connecting portion 267 of terminal 258 from electrically engaging the inside surface 36 of rear panel 32 in the panel assembly, as seen in FIG. 23. In this embodiment, both of the arms 262, 268 of terminal 238 are compressed inwardly with respect to surfaces 241 and 243 when panels 22, 32 are secured thereto. When the door is assembled, the mounting post 239 is proximate the center of slot 257.

FIGS. 24 and 25 illustrate how terminal 258 automatically breaks the circuit to circuit member 270 if either of the panels 22, 32 is removed or broken. If the front panel 22 is removed or broken, the front arm 262 springs outwardly, causing insulating member 251 to move in the plane in a direction away from the back panel 32 until the mounting post 239 engages the rearmost end of slot 257. The insulating leg 255 also pivots and slides rearwardly along the connecting portion 267 of rear arm 268 of terminal 258, reducing pressure on the arm 268 and allowing the connecting portion 269 to become disengaged from circuit member 270. If the back panel 32 is removed or broken, the release of the compressive force on the spring arm 268 of terminal 258 causes the connecting portion 269 to break the circuit as the spring arm 268 resiles outwardly beyond second outer surface 243. Concomitantly the insulating member 251 moves in the plane in a direction toward the front panel 22 until the mounting post 239 is proximate the forward most end of slot 257, as shown in FIG. 25. Embodiment 240 has the advantage of being usable when the back panel 32 includes a conductive coating or other circuitry that should not come into electrical engagement with terminal 258. The insulating member 251 eliminates the need to apply an insulating layer along the interior surface 36 of the back panel 32 to prevent electrical contact between a terminal and the back panel, as previously described.

The present invention provides interlock connectors that include safety features for a an apparatus, such as a panel assembly that automatically break the circuit to a power source if either panel is moved from a first or assembled position to a second or partially assembled position. The connectors of the present invention are suitable for use as an interlock between power sources and electrical units in various kinds of apparatus. It is also to be recognized that the apparatus portions against which the connector is mounted is not limited to opposed portions. For example, an electrical terminal in the connector may be formed in such a manner that the apparatus engaging portions are on adjacent sides of the housing.

It is thought that the electrical connector and panel assembly therefor of the present invention and many of their attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical interlock connector for interconnecting a power source to an electrical unit within an apparatus, said electrical connector being mountable within the apparatus against portions thereof and comprising:

an insulating housing with first and second outer surfaces associated with respective portions of the apparatus;

the housing containing at least one terminal-receiving cavity in communication with said first outer surface;

an electrical terminal disposed in said at least one cavity and having a body portion and a spring section, said spring section having an outer connecting portion and an inner connecting portion with said outer connecting portion being adapted to be electrically connected to said electrical unit; and a first circuit member connected to said power source and attached to said housing;

said outer connecting portion resiliently extends outwardly of said first outer surface to an open position wherein said terminal and said first circuit member are electrically disconnected;

said outer connecting portion being movable toward said first outer surface and into said cavity to a closed position by a first portion of the apparatus upon mounting the connector in the apparatus against said first portion and a second portion, said connector having a section along said second outer surface that engages a second apparatus portion, said connector section being remote from and relatively movable with respect to said spring section;

whereby said inner connecting portion is at least in electrical connection with said first circuit member only when said connector is against said first portion and said second portion of the apparatus and said terminal is in its closed position thereby interconnecting said power source to said electrical unit.

2. The electrical interlock connector of claim 1 wherein the connector section is a second terminal that is disengaged from said first circuit member unless biased by said second apparatus portion, said second terminal being disposed in a second terminal-receiving cavity in said housing, said second terminal having a body portion and a spring section including an outer connecting section and an inner connecting section such that upon biasing said second terminal said inner connecting section thereof engages the first circuit member and concomitantly therewith said first apparatus portion moves the inner connecting portion of the terminal in said at least one cavity into electrical engagement with the body of the second terminal thereby effecting interconnection between said power source and said electrical unit.

3. The electrical interlock connector of claim 1 wherein said connector section is an insulating member that is biased by said second apparatus portion such that a second spring section of the terminal engages said circuit member, said insulating member being mounted within said housing proximate said terminal in a manner to permit movement from an initial position to at least one other position, the second spring section having an outer connecting portion resiliently extending outwardly of the second outer surface of the housing and an inner connecting portion that is adapted to electrically engage the circuit member upon being moved by the insulating member to its closed position.

4. The electrical interlock connector of claim 1 wherein said connector portion is the second outer surface of said housing, said second surface being in engagement with said second apparatus portion when the connector is mounted in the apparatus.

5. The electrical interlock connector of claim 4 wherein said connector is disposed in and is freely slidable within a frame in a direction perpendicular to the first outer surface from a first position to a second position, such that the outer connecting portion of the terminal is moved to the closed position and the inner connecting portion thereof is brought into engagement with the first circuit member.

6. An electrical interlock connector for interconnecting a power source to an electrical unit within an apparatus, said electrical connector being mountable within the apparatus against portions thereof, and comprising:

an insulating housing with first and second outer surfaces and having first and second terminal-receiving cavities;

first and second terminals associated with respective ones of said first and second terminal-receiving cavities, said first and second terminals including body portions and spring sections, said spring sections being disposed in respective ones of said terminal-receiving cavities and having outer connecting portions and inner connecting portions, with said outer connecting portions resiliently extend outwardly of said first and second surfaces, respectively, to open positions wherein said first and second terminals are electrically isolated when resiled; and a first circuit member connected to said power source and attached to said housing and at least exposed within said second terminal-receiving cavity to be engaged by said second terminal when in its closed position;

said first terminal being adapted to be electrically connected to said electrical unit and said second terminal being adapted to be connected to said first circuit member;

said outer connecting portion of said first terminal being movable toward said first surface to a closed position within said first cavity by engagement with a first portion of the apparatus when the connector is mounted therein wherein said first inner connecting portion is in electrical engagement with said body portion of said second terminal within said first cavity; and said outer connecting portion of said second terminal being movable toward said second surface to a closed position within said second cavity by engagement with a second portion of the apparatus wherein said inner connecting portion of said second terminal is in electrical engagement with said first circuit member upon mounting of the connector within the apparatus;

so that only when both said first and second terminals are in their closed positions is said first terminal in electrical engagement with said first circuit member thereby interconnecting said power source to said electrical unit.

7. The electrical interlock connector of claim 6 wherein said first and second terminal-receiving cavities extend to a common end wall of said housing, said first and second cavities being separated by an inner housing wall.

8. The electrical interlock connector of claim 6 wherein said first and second spring sections are U-shaped spring arms, and are joined to respective said body portions by bights.

9. The electrical interlock connector of claim 8 wherein each outer connecting portions is proximate a base of the "U" of a respective one of said first and second terminals and each of said inner connecting portions is proximate a leading end of said spring arm of a respective one of said first and second terminals.

10. The electrical interlock connector of claim 8 wherein said first and second terminal-receiving cavities extend to a common end wall of said housing and are separated by an inner wall thereof, said first terminal-receiving cavity including first and second terminal-receiving slots, said body portion of said first terminal being inserted into said first slot with said bight of said first terminal being at an inner end of said cavity and said spring arm of said first terminal extending toward an open end of said first cavity, and said second terminal being inserted into said housing with said body portion of said second terminal being received in said second slot and extending between said first terminal body portion and said spring arm thereof, said bight of said second terminal being disposed around said inner wall with said spring arm of said second terminal extending toward an inner end of said second cavity.

11. The electrical interlock connector of claim 9 wherein said first circuit member includes a conductive tab portion extending into said second terminal-receiving cavity, such that upon moving said spring section of said second terminal to said closed position, said inner connecting portion of said second terminal electrically engages said tab portion of said circuit member.

12. The electrical interlock connector of claim 6 wherein said first circuit member includes a third terminal terminated to a conductor, said third terminal including a connecting section exposed within said second terminal-receiving cavity and adapted to be electrically connected to said inner connecting portion of said second terminal upon moving said first and second terminals to said closed positions.

13. The electrical interlock connector of claim 12 wherein said third terminal is secured in a circuit member-receiving passageway that extends into said housing and is in communication with said second terminal-receiving cavity, and said connecting section of said first circuit member is a tab that extends into said second terminal-receiving cavity.

14. The electrical interlock connector of claim 6 wherein said housing further includes retention portions extending outwardly from opposite sides of a terminal-receiving body containing said first and second terminal-receiving cavities, said retention portions being adapted to retain said connector in a desired position for connection to said electrical unit.

15. The electrical interlock connector of claim 14 wherein said retention portions extend at an angle to said terminal-receiving body and at a right angle with respect to one another such that said connector may be secured in a corner of an assembly for electrical connection to said electrical unit.

16. The electrical interlock connector of claim 15 wherein said apparatus is a panel assembly and wherein said first and second apparatus portions are opposed to one another, each having respective portions against which said connector is mounted.

17. The electrical interlock connector of claim 16 wherein said first and second panels of said panel assembly are glass.

18. The electrical interlock connector of claim 14 wherein said retention portions further include respective recesses along the outer surfaces thereof adapted to receive electrical conductors therealong.

19. An electrical interlock connector for interconnecting a power source to an electrical unit within an apparatus, said electrical connector being mountable within the apparatus against portions thereof and comprising:

an insulating housing with first and second surfaces, said housing being freely slidable within a frame in a direction perpendicular to said first surface from a first position to a second position;

an electrical terminal disposed in a cavity in said housing, said terminal having an outer connecting portion and an inner connecting portion, said outer connecting portion being adapted to be electrically connected to said electrical unit; and a first circuit member connected to said power source and attached to said housing and at least exposed within said cavity;

wherein said outer connecting portion resiliently extends outwardly of said first surface to an open position wherein said terminal and said first circuit member are electrically spaced apart;

said outer connecting portion being movable toward said first surface and into said cavity to a closed position by a portion of the apparatus upon mounting of the connector therein wherein said inner connecting portion is in engagement with said first circuit member, so that only when both said housing is in said first position and said terminal is in said closed position is said terminal in electrical engagement with said first circuit member thereby interconnecting said power source to said electrical unit.

20. The electrical interlock connector of claim 19 wherein said frame for said connector is disposed on a base of a module adapted to be mounted in said apparatus, said base including an aperture within walls of said frame extending therethrough and dimensioned to receive said outer connecting portion of said terminal therethrough for electrical engagement with said first apparatus portion, said module further including a cover having a further aperture dimensioned to receive said second housing surface therethrough when said connector is in the second position.

21. The electrical interlock connector of claim 20 wherein said connector housing includes shoulders extending outwardly from opposed sides thereof at a selected location against said first and second outer surfaces and substantially parallel to said first and second surfaces, said shoulders being received in corresponding slots in side walls of said frame thereby positioning said connector in said frame while allowing said housing to move between said first and second positions.

22. The electrical interlock connector of claim 21 wherein said shoulders of said connector engaging an inner surface of said cover thereby retaining said connector within said module.

23. The electrical interlock connector of claim 19 wherein said terminal includes a body and a spring section, said spring section being a U-shaped spring arm, said outer connecting portion being proximate a base of the "U" and said inner connecting portion being proximate a leading end of the spring arm.

24. An electrical interlock connector for interconnecting a power source to an electrical unit within an apparatus, said electrical connector being mountable within the apparatus against portions thereof and comprising:

an insulating housing with first and second surfaces, an electrical terminal disposed in a cavity in said housing, said terminal having an outer connecting portion and an inner connecting portion, said outer connecting portion being adapted to be electrically connected to said electrical unit; and a first circuit member connected to said power source and attached to said housing and at least exposed within said cavity;

wherein said outer connecting portion resiliently extends outwardly of said first surface to an open position wherein said terminal and said first circuit member are electrically spaced apart;

said outer connecting portion being movable toward said first surface and into said cavity to a closed position by a portion of the apparatus upon mounting of the connector therein wherein said inner connecting portion is in engagement with said first circuit member, so that when said housing is against said first and second apparatus portions and said terminal is in said closed position said terminal is in electrical engagement with said first circuit member thereby interconnecting said power source to said electrical unit.

25. The electrical interlock connector of claim 24 wherein said terminal includes a body and a spring section, said spring section being a U-shaped spring arm, said outer connecting portion being proximate a base of the "U" and said inner connecting portion being proximate a leading end of the spring arm.

26. The electrical interlock connector of claim 25 wherein said housing further includes retention portions extending outwardly from opposite sides of a terminal-receiving body containing said terminal-receiving cavity, said retention portions being adapted to retain said connector in a desired position for connection to said electrical unit.

27. The electrical interlock connector of claim 26 wherein said retention portions extend at an angle to said terminal-receiving body and at a right angle with respect to one another such that said connector may be secured in a corner of an assembly for electrical connection to said electrical unit.

28. An electrical interlock connector for interconnecting a power source to an electrical unit within an apparatus, said electrical connector being mountable within the apparatus against portions thereof and comprising:

an insulating housing with first and second outer surfaces associated with respective portions of the apparatus;

the housing containing at least one terminal-receiving cavity having first and second portions, each portion being in communication with a corresponding one of said first and second outer surfaces;

an essentially U-shaped electrical terminal disposed in said at least one cavity and having first and second spring sections extending from a body portion, each of said first and second spring sections being disposed in a corresponding one of said first and second cavity portions, each said spring section having an outer connecting portion and an inner connecting portion, said outer connecting portion of said first spring section being adapted to be electrically connected to said electrical unit;

an insulating member mounted within the housing proximate the terminal body in a manner to permit movement from an initial position to at least one other position, said member including an elongate section having one surface that extends along said outer connecting section of said second spring section, and another surface that is adapted to engage a second apparatus portion; and a first circuit member connected to said power source and attached to said housing;

said outer connecting portions of both said first and second spring sections resiliently extend outwardly of corresponding ones of said first and second outer surfaces to open positions wherein said terminal and said first circuit member are electrically disconnected;

said outer connecting portion of said first spring section being movable toward said first outer surface and into said first cavity portion to a closed position by a first portion of the apparatus and said outer connecting portion of said second spring section being movable toward said second outer surface and into said second cavity portion to a closed position by said insulating member upon mounting the-connector in the apparatus against said first and second portions;

whereby said inner connecting portion of said second spring section is in electrical connection with said first circuit member only when said connector is against said first portion and said second portion of the apparatus and both of said first and second spring sections of said terminal are in their closed positions thereby interconnecting said power source to said electrical unit.

29. An apparatus including first and second panels, at least one of said panels having an electrical unit thereon, said unit including first and second connecting areas at two selected locations on said at least one panel;

at least first and second panel portions associated with said first connecting area;

at least one electrical connector for interconnecting a power source to said first connecting area, said connector being mountable against said first and second panel portions, said connector including:

an insulating housing with first and second outer surfaces each associated with a corresponding one of said first and second panel portions;

the housing containing at least one terminal-receiving cavity in communication with said first outer surface;

an electrical terminal disposed in said at least one cavity and having a body portion and a spring section, said spring section having an outer connecting portion and an inner connecting portion with said outer connecting portion being adapted to be electrically connected to said first connecting area of said electrical unit; and a first circuit member connected to said power source and attached to said housing;

said outer connecting portion resiliently extends outwardly of said first outer surface to an open position wherein said terminal and said first circuit member are electrically disconnected;

said outer connecting portion being movable toward said first outer surface and into said cavity to a closed position by said first panel portion upon mounting the connector in the apparatus against said first and second panel portions, said connector having a section along said second outer surface that engages said second panel portion, said connector section being remote from and relatively movable with respect to said spring section;

whereby said inner connecting portion is at least in electrical connection with said first circuit member only when said connector is against said first and second panel portions and said terminal is in its closed position thereby interconnecting said power source to said first connecting area of said electrical unit; and a second circuit member connected to said power source and electrically engaged by an interconnecting element to said second connecting area on said at least one panel of said apparatus thereby completing an electrical circuit and interconnecting said power source to said electrical unit.

30. The apparatus of claim 29 wherein said interconnecting element is another electrical terminal.

31. The apparatus of claim 29 wherein said connector section of said at least one connector includes:

a second terminal that is disengaged from said first circuit member unless biased by said second panel portion, said second terminal being disposed in a second terminal-receiving cavity in said housing, said second terminal having a body portion and a spring section including an outer connecting section and an inner connecting section such that upon biasing said second terminal said inner connecting section thereof engages the first circuit member and concomitantly therewith said first apparatus portion moves the inner connecting portion of the terminal in said at least one cavity into electrical engagement with the body of the second terminal thereby effecting interconnection between said power source and said electrical unit.

32. The apparatus of claim 29 wherein said connector section of said at least one connector is an insulating member that is biased by said second apparatus portion such that a second spring section of the terminal engages said circuit member, said insulating member being mounted within said housing proximate said terminal in a manner to permit movement from an initial position to at least one other position, the second spring section having an outer connecting portion resiliently extending outwardly of the second outer surface of the housing and an inner connecting portion that is adapted to electrically engage the first circuit member upon being moved by the insulating member to its closed position.

33. The apparatus of claim 29 wherein said wherein said first and second panels are glass.

34. The apparatus of claim 29 further including a sensing module adapted to determine when said power source is to be activated.

35. The apparatus of claim 29 wherein said interconnecting element is a second connector mounted to said apparatus against third and fourth panel portions.

36. The apparatus of claim 33 wherein said second connector includes:

an insulating housing with first and second outer surfaces each associated with a corresponding one of said third and fourth panel portions;

the housing containing at least one terminal-receiving cavity in communication with said first outer surface; and an electrical terminal disposed in said at least one cavity and having a body portion and a spring section, said spring section having an outer connecting portion and an inner connecting portion with said outer connecting portion being adapted to be electrically connected to said second connecting area of said electrical unit;

said second circuit member being attached to said housing;

said outer connecting portion resiliently extends outwardly of said first outer surface to an open position wherein said terminal and said second circuit member are electrically disconnected;

said outer connecting portion being movable toward said first outer surface and into said cavity to a closed position by said first panel portion upon mounting the connector in the apparatus against said third and fourth panel portions, said connector having a section along said second outer surface that engages said fourth panel portion, said connector section being remote from and relatively movable with respect to said spring section, whereby said inner connecting portion is at least in electrical connection with said second circuit member only when said connector is against said third and fourth panel portions and said terminal is in its closed position thereby interconnecting said power source to said second connecting area of said electrical unit.

37. The apparatus of claim 29 wherein said connector section of said at least one connector is the second outer surface of said housing, said second surface being in engagement with said second panel portion when the connector is mounted in the apparatus.

38. The apparatus of claim 37 wherein said connector is disposed in and is freely slidable within a frame in a direction perpendicular to the first outer surface from a first position to a second position, such that the outer connecting portion of the terminal is moved to the closed position and the inner connecting portion thereof is brought into engagement with the first circuit member.

39. The apparatus of claim 29 wherein said wherein said first and second panels are opposed to one another.

40. The apparatus of claim 39 further including a sensing module adapted to determine when said power source is to be activated.

* * * * *